US005724079A

United States Patent [19]

Helinski et al.

[11] Patent Number: 5,724,079

[45] Date of Patent: Mar. 3, 1998

[54] COMBINED BLACK AND COLOR INK JET PRINTING

[75] Inventors: Edward Frank Helinski, Johnson City; Ho Chong Lee, Endicott; Jack Louis Zable, Vestal, all of N.Y.

[73] Assignee: Internaional Business Machines Corporation, Armonk, N.Y.

[21] Appl. No.: 332,709

[22] Filed: Nov. 1, 1994

[51] Int. Cl.[6] ..... B41J 2/21; B41J 2/145; B41J 2/15

[52] U.S. Cl. ..... 347/43; 347/40

[58] Field of Search ..... 347/40, 41, 43

[56] References Cited

U.S. PATENT DOCUMENTS

| | | | |
|---|---|---|---|
| 4,459,601 | 7/1984 | Howkins . | |
| 4,554,556 | 11/1985 | Hirata et al. . | |
| 4,593,295 | 6/1986 | Matsufuji et al. . | |
| 4,682,216 | 7/1987 | Sasaki et al. . | |
| 4,728,968 | 3/1988 | Hillmann et al. . | |
| 5,057,852 | 10/1991 | Formica et al. | 347/43 |
| 5,075,689 | 12/1991 | Hoisington et al. | 347/41 |
| 5,079,571 | 1/1992 | Eriksen . | |
| 5,124,716 | 6/1992 | Roy et al. . | |
| 5,155,498 | 10/1992 | Roy et al. . | |
| 5,239,312 | 8/1993 | Merna et al. | 347/41 |

*Primary Examiner*—Benjamin R. Fuller
*Assistant Examiner*—Thinh Nguyen
*Attorney, Agent, or Firm*—Calfee, Halter & Griswold LLP

[57] ABSTRACT

The present invention provides an ink jet printer which has a mechanism for receiving and incrementing paper or other ink-receiving medium vertically and a print head and a mechanism for moving the print head horizontally across the paper. The print head has a plurality of orifices and associated operating devices to eject ink drops from each orifice. In particular, the orifices are configured such that there is a plurality of black ink orifices to print black ink, which is generated by a single black color from an orifice or orifices, and a plurality of color ink orifices to print color ink, whereby the color is generated by three different color inks, with each color ink being ejected from a separate orifice or orifices. The orifices are arranged in a pattern in which the orifices are spaced vertically and horizontally with respect to each other. In this pattern, there is at least one color ink orifice interposed or interspersed between two black ink orifices in the vertically spaced direction. The vertical spacing of the orifices is typically one dot distance. With this configuration, the full height of all of the orifices combined can be utilize for printing during a single swath for printing black lines or characters.

5 Claims, 5 Drawing Sheets

COMBINED BLACK AND COLOR INK JET PRINTING

FIELD OF THE INVENTION

This invention relates generally to ink jet printing, and more particularly to ink jet printing utilizing both black ink and color ink. In even more specific aspects, this invention relates to ink jet printing wherein color ink jet pels are interspersed with black ink jet pels to enhance the speed of printing in ink jet printers.

BACKGROUND OF THE INVENTION

A very common form of printing both alphanumeric characters and graphic figures is by utilizing ink jet printing technology. In ink jet printing, a print head is provided which has a plurality of horizontally and vertically-spaced nozzles. The nozzles are connected to an ink supply and each is provided with an actuating device, which actuating devices can be selectively actuated to expel a drop of ink on demand. The printing device includes a roller or other type of mechanism to support a target, such as a sheet of paper, and a mechanism for incrementally indexing the paper, i.e., to move it an incremental amount vertically.

The print head is moved horizontally across the paper, and the orifices or nozzles are actuated according to a program to expel drops of ink which impinge on the paper or other substrate to form a desired pattern. The height of the pattern or the swath traversed by the ink jet nozzles is dependent upon the number of nozzles and their vertical spacing with respect to each other. During the traverse, a program controls the operation of each of the jets individually to eject a drop on demand so that when the traverse is completed, drops of ink have been impinged on the paper in the desired pattern.

The printing density is typically quantified in terms of dots/inch. Its inverse is the distance between adjacent dots, and is referred to as the pixel distance. The dot or spot size produced by each drop that impinges on the paper is somewhat larger than the pixel distance, causing some overlap between adjacent dots. The grouping or arrangement of the ink dots forms the pattern to be printed. For quality printing, i.e., letter quality (LQ) or near letter quality (NLQ), it is generally accepted that the spacing between each of the ink jet dots be at the highest printing density, both vertically and horizontally. The vertical spacing is accomplished by controlling the vertical spacing between the nozzles, and the horizontal spacing of the dots is controlled by the speed at which the print head moves horizontally and the ink jet drop generation rate. Once the traverse or swath or sweep has been completed by the print head in one direction, e.g., from left to right, the paper is indexed by an amount equal to the height of the swath or the line being printed or other predetermined distance. Thus, the next line is ready for printing. In most present day ink jet printers, printing occurs not only on the traverse from left to right, but also printing occurs on the traverse from right to left. Hence, once the traverse from left to right of the print head has taken place and the line printed, the paper is indexed, and the print head then is moved from right to left, printing the desired characters or shapes from right to left. Appropriate programs store the line of text or other material to be printed and thus allow the printing from right to left, as well as from left to right. This increases the speed of printing in that the print head does not have to be returned from right to left after each line is printed.

Ink jet printers are presently available wherein the black ink is generally available for printing text and/or some geometric shapes. The color ink is generally used to print color graphs and maps. Some low end printers print only in black ink, however many printers are configured to print in both black ink and in color ink. To print in colors, it is conventional to use three different subtractive colors, i.e., cyan, magenta and yellow, and provide individual nozzles or orifices for each of the colors. Desired colors are formed by combining these three colors in various combinations and proportions. This combination takes place by individually actuating each color nozzle for the period of time required for a particular drop at each location. Thus, as each color nozzle reaches that particular location, it is actuated to provide the necessary colors. Typical prior art nozzle configurations will be discussed infra.

In some ink jet color printing operations, the printhead is capable of printing only the three colors, and when characters or other lines or shapes are required which normally require a black ink, the three colors are deposited at the same location. While this is sometimes referred to as a "black" dot, in reality it is really not a "real" black color, but is "near" or "pseudo" black. In some color printers, this is the only way of printing "black" characters or shapes. However, in many color printers, a print head is provided with the capability of printing both true black dots from black ink, as well as printing color dots. Thus, textual material or other materials requiring true black dots are printed from nozzles, each of which project black ink drops, and color printing is done as described above utilizing combinations of three separate colors of inks. In this type of print head, the nozzles or orifices for the black ink are all arranged in one or more bands of orifices or nozzles which are vertically and horizontally spaced. Typically, the vertical distance between nozzles is equal to one pixel distance. The color nozzles are arranged in one or more bands either above or below the bands of nozzles for the black ink, the color nozzles being also horizontally and vertically spaced. Here again, the vertical spacing is typically one pixel distance between adjacent nozzles. Thus, the printing of the black lines or characters such as text requiring black, is printed in a single swath whose height is equal to the vertical height of the array of orifices comprising the orifices for the black ink. Of course, the array of color nozzles or jets could be used to form near black spots during the same traverse of the head, but these would constitute a distinct and distinguishable portion of the character and, according to prior art, color nozzle arrangements cannot effectively be incorporated as part of the real black dots or done in a single pass. Moreover, as described above, and as indicated in U.S. Pat. No. 5,079,571, such near black, or as characterized therein improper black color has a "noticeable, dingy and repugnant hue." (Col. 8, lines 55–61) Hence, in prior art print heads, the thruput is restricted to the black ink nozzles if a black character is desired.

Accordingly, it is an object of the present invention to provide a color ink jet printer which can print both color and black dots and wherein the color printed dots are utilized to increase the thruput capability of the printer in textual or other graphical material utilizing black lines which gives the appearance of a true black, while utilizing the near black dots.

Another object of this invention is to provide an ink jet printer that utilizes interspersed black dots and color dots to increase draft printing speed.

SUMMARY OF THE INVENTION

According to the present invention, an ink jet printer and method of printing is provided and which printer has a mechanism for receiving and incrementing paper or other ink-receiving medium vertically and a print head and a mechanism for moving the print head horizontally across the paper. The print head has a plurality of orifices and associated operating devices to eject ink drops from each orifice. In particular, the orifices are configured such that there is a plurality of orifices to print black ink, a plurality of orifices to print color ink, the color being generated by three different color inks, with each color ink being ejected from separate orifices and the black ink being generated by a single black color ejected from separate orifices. The orifices are arranged in a pattern in which the orifices are spaced vertically and horizontally with respect to each other. In this pattern, there is at least one color ink orifice interposed or interspersed between two black ink orifices in the vertically spaced direction. The vertical spacing between the color and black orifices is typically equal to one pixel distance. With this configuration, the full height of all of the orifices combined can be utilized for printing during a single swath for printing black lines or characters.

In one embodiment, the interspersed nozzles for the color have rows of one of each of the three color nozzles horizontally aligned. In this embodiment, during a traverse of the printing head from one side to the other, all of the black nozzles can be utilized to print black dots. The three color nozzles are each actuated during the same pass successively such that their respective color dots overlap to print near black or pseudo black dots. Since the "near" black dots are interspersed between two "real" black dots to create the line, character or figure, it is difficult for the eye to detect the difference in the line character; i.e., there are dispersed near black and true black dots such that the line gives an essentially uniform appearance of virtually a black color as opposed to a segment of the line having true black color and another segment of the line having near black color. Thus, all of the vertically aligned orifices are available for the entire width to print letter quality or near letter quality essentially black lines.

In another embodiment, a vertical spacing of the nozzles or orifices is such that the color nozzles for the color ink are interspersed individually between the nozzles for the black ink, i.e., the nozzles for the three colors are not horizontally in line with each other, but rather are each individually interspersed between the nozzles for black ink. In this configuration for draft quality work, the entire vertical array of nozzles can be actuated. In this case, the line is printed with alternate black dots and color dots, which provides a sufficiently black looking line for draft purposes (not letter quality or near letter quality). If letter quality is desired, multiple passes of the print head using only the black nozzles can be made with appropriate incrementing of the paper between passes to provide characters with true black lines. The true black line, of course, requires two passes for the same line of characters or for the same swath to be printed in which the dots are made from the black ink.

DESCRIPTION OF THE DRAWING

FIGS. 4A–6A are representations of characters printed using color interspersed from the nozzles shown in FIGS. 4–6, respectively.

DESCRIPTION OF THE PREFERRED EMBODIMENT(S)

Figure 1:
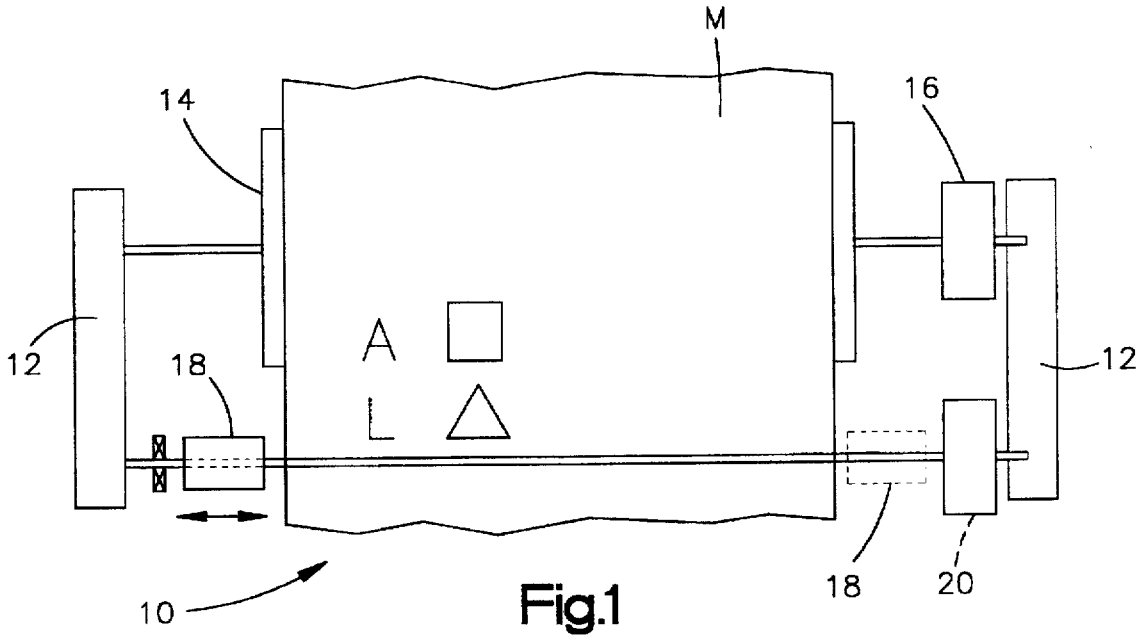
FIG. 1 is an elevational view, somewhat schematic, of portions of an ink jet printer incorporating a print head having jet nozzles.

Referring now to FIG. 1, a portion of an ink jet printer is shown and designated generally by the reference character 10. The printer and certain of its various parts are shown just generally inasmuch as the present invention can be incorporated into any ink jet printer that has a head which can print both true black ink dots and color ink dots. In general, the printer 10 includes a frame 12 which mounts the various components of the printer. The printer includes a roller 14 which is adapted to receive and incrementally move therethrough a sheet of paper or other ink-receiving medium M, such as sheets of plastic, cardboard or other planar material. The roller 14 is driven by a roller drive 16 which, in a well-known manner and under the control of a program from a microprocessor (not shown), is configured to incrementally rotate the roller to thereby move the paper or other print receiving medium in a well-known manner.

Figure 2:
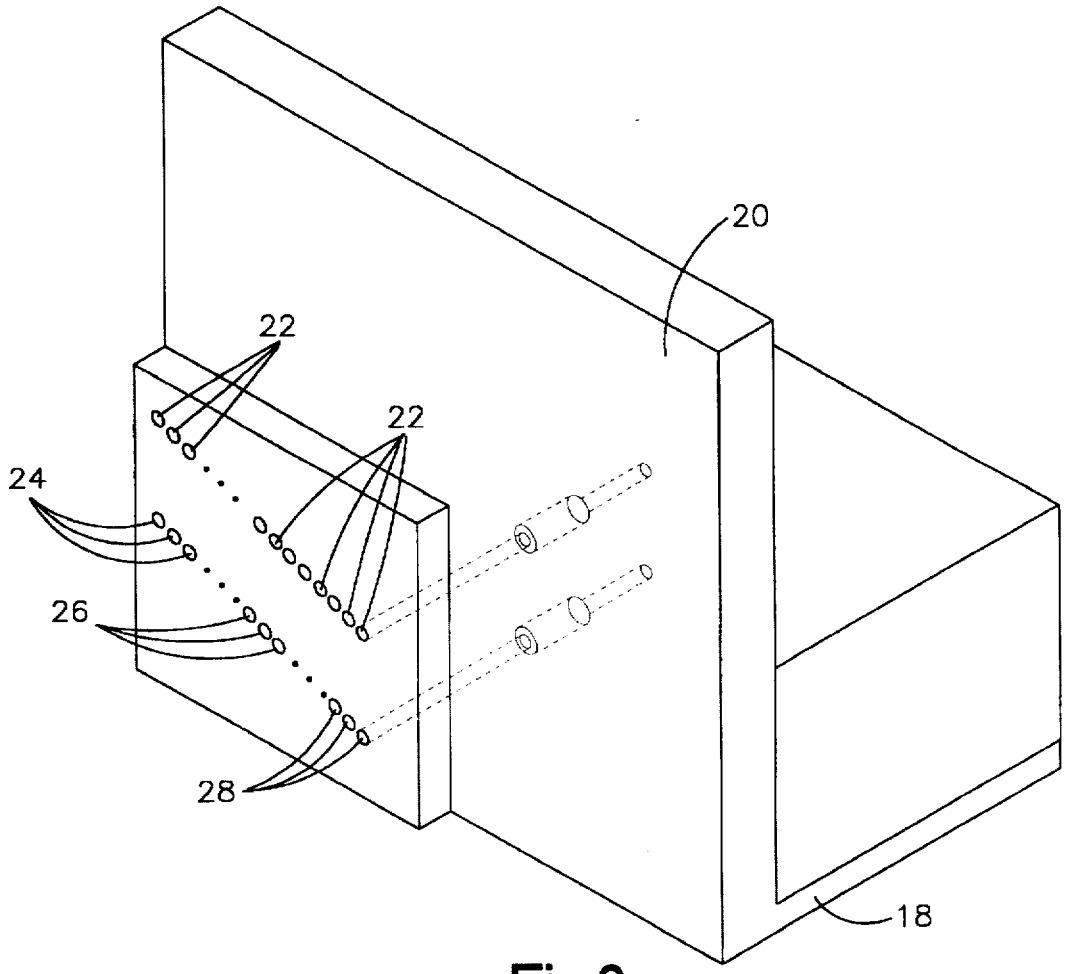
FIG. 2 is a somewhat schematic perspective representation of the arrangement of nozzles in an ink jet print head.

The printer 10 also includes a print head 18 which is driven by a print head drive system 20 that is adapted to drive the print head horizontally with respect to the roller 14. The print head 18 is provided with a face plate 20 having a plurality of nozzles or orifices 22, 24, 26, 28 (only a few nozzles are shown in FIG. 2). The actual number and spacing of the nozzles are dependent upon several factors which will be described presently. The orifices are provided with suitable actuators (not shown) and ink reservoirs (not shown) to expel drops of ink upon demand under control of the program and the microprocessor (not shown). Such structures are well-known in the art and need not be further described in detail.

Figure 3:
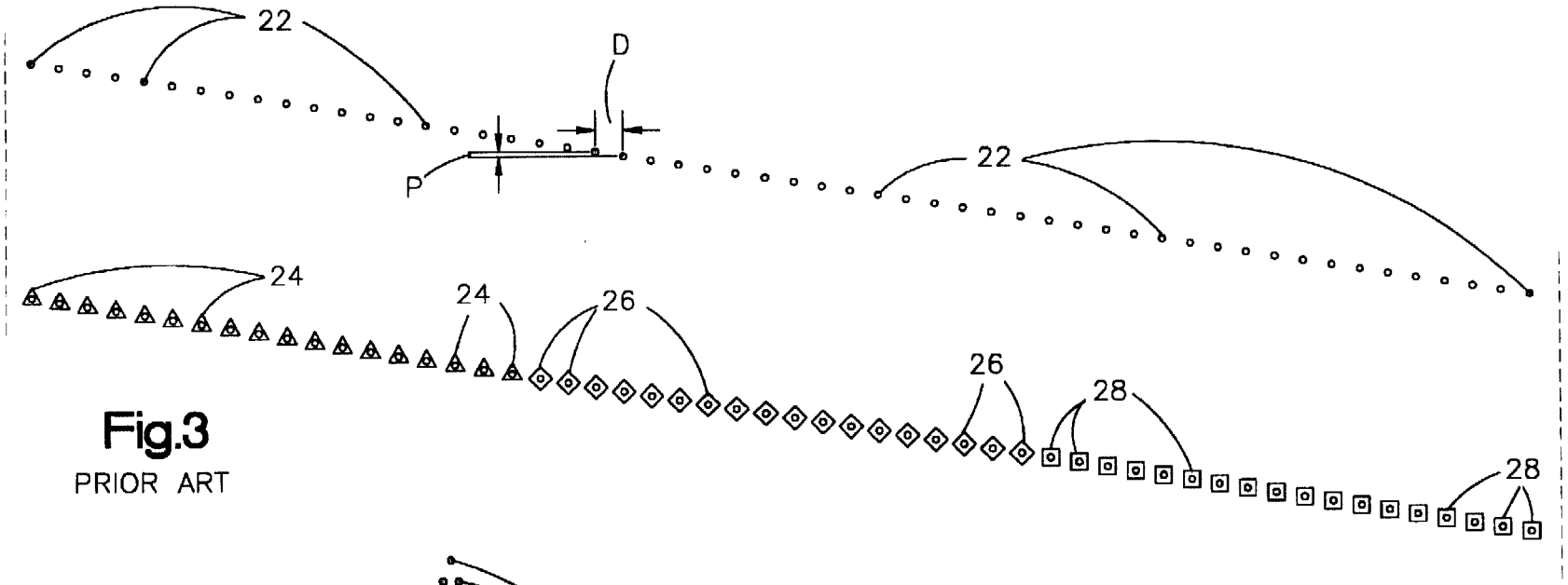
Fig.3 PRIOR ART
FIG. 3 is a representation of the nozzles, or orifice openings in a typical prior art print head, which can print with both black and color inks.

The orifices in a color ink jet printer which can print in color inks and black inks, according to one prior art scheme, are arranged as shown in FIG. 3. In this figure, orifices 22 are black orifices or nozzles, orifices 24 are cyan color ink nozzles or orifices, orifices 26 are magenta color ink orifices or nozzles, and orifices 28 are yellow color ink nozzles or orifices. These three colors (which are subtractive primary colors) can be combined to form a broad range of colors in ink jet printing in a well known manner. The nozzles have been shown with various geometric shapes to aid in identification. The black ink nozzles 22 are shown as circles, the cyan ink nozzles 24 are shown as triangles, the magenta ink nozzles 26 are shown as diamonds, and the yellow ink nozzles 28 are shown as squares. These are for identification purposes only and do not represent the shape of the nozzles, which are generally circular in shape. As can be seen in FIG. 3, this prior art print head 18 has 54 black ink nozzles and 54 color ink nozzles. The nozzles are arranged in two diagonally slanted extending rows, with the black ink nozzles 22 contained in one group and which nozzles are horizontally and vertically spaced with respect to each other, and the color ink nozzles 24, 26 and 28 arranged therebelow in another diagonally slanted extending group, which nozzles are horizontally and vertically spaced.

The spacing of the nozzles is dictated by both requirements of the size of the dot and the constraints as to how close physically the nozzles can be effectively space for mechanical and other constructural limitations as well as operational constraints. Generally, the physical spacing of the nozzles must provide approximately 0.050 inches between any two adjacent nozzles. Thus, this determines the minimum horizontal distance or "D" between any two nozzles; and the vertical spacing, or "P", between centers of adjacent nozzles is dictated by the pixel distance, which generally is about 0.0033 inches (300 dots/inch). The vertical spacing should not exceed a distance of about one pixel if good quality printing is desired.

Figure 3A:
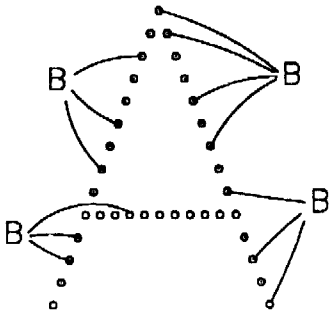
Fig.3A PRIOR ART
FIG. 3A is a representation of a character printed in black from the nozzles shown in FIG. 3.

For black text printing in the embodiment shown in FIG. 3, print head 18 starts at the left and traverses to the right. Printing is initiated when the first of the black ink nozzles 22 cross the left-most accessible pel of the first column of characters which are to be printed. FIG. 3A shows a simulated representation of the letter "A" printed by the nozzles 22 of the print head of FIG. 1. The dots are shown larger and out of scale, and many more dots would be used to form the letter than are actually shown. However, this is a depiction of how dots are arranged to form a character. In this case, the letter "A" is formed only from the black ink nozzles 22. This is "true" black. The print head 18 is traversing at a constant velocity which is determined by the horizontal pel distance and the frequency at which jets of ink can be generated. As the head continues to move to the right, the required nozzles 22 will be activated to deposit drops of ink and this process continues with the print head moving at a constant velocity to the right until all of the pels required from the black ink nozzle for this swath have been printed. A print swath equal to the vertical distance covered by the black nozzles 22, as indicated above, has a height of about 0.18 inches, is printed. When the print head has traversed across the paper, the paper is incremented up 0.18 inches, and the print head motion is reversed. The print head then prints another swath of black characters 0.18 inches high as it moves from right to left. Thus, on a swath printed from left to right and a swath printed from right to left after incrementing, a height of 0.36 inches of character can be printed in black. The color ink nozzles are not used to print black characters.

It should be noted in some print heads that the vertical spacing between two nozzles, i.e., the distance P, is equal to twice the pixel distance or 0.0067 inches. In this case, when the print head traverses from left to right, it will print a swath 0.36 inches high. However, in this case, every other dot row (vertically) will be printed and, when the head reaches the far right side of the paper, the head direction is reversed and the paper is incremented a distance of one-half P, or 0.0033 inches. The print head then moves from left to right, printing a swath 0.36 inches high and filling in the dot rows that had been left blank in the previous pass. When the print head reaches the left side of the paper, the swath of 0.36 inches is fully printed. In either case, a pass from left to right, followed by a pass from right to left, prints a row of characters 0.36 inches high.

In order to print a color line, multiple passes are required, with the print medium, M, incremented between each pass. In the first pass, wherever yellow is to be used as part of the color, the yellow ink nozzles 28 are actuated; then the roller is incremented to move the ink-receive medium M up 0.06 inches (i.e., 18 pixel distance) and another pass made using the magenta ink nozzles 26 to add the magenta where required to the previously laid down swath of yellow dots. Also, during this same pass, the next low swath of yellow dots is laid down. Thereafter, the paper is again incremented 0.06 inches and the head again moved horizontally, and drops of cyan ink are deposited from the cyan ink nozzles 24 as required. This ink completes the three colors required to generate the required line on the first swath of 0.06 inches. Also, during this pass, the next swath of yellow is deposited, and the magenta over the previously created swath of yellow. This continues until all lines have been printed. Once the initial two swaths have been created, it takes three passes to create a line 0.18 inches high of color.

As indicated earlier, in order to provide a "near black" color, it is required to combine the cyan, magenta and yellow. If this were to be done at the bottom of a part of a character formed with the 54 black nozzles, it would have a distinctively different color, as was indicated previously, thus making a character formed from both the near black of the color nozzles and the true black of the black nozzles, having a distinctive two color characteristic—the lower portion being one color and the upper portion being another color. Moreover, it would require three passes to form a near black dot. Thus, two extra moves would be required, although the line height would be 0.24" high (72×0.0033). Thus, for black printing, especially for letter quality or near letter quality printing, the prior art has utilized only the black ink nozzles for printing black lines for printed type alphanumeric characters and the like, and has used the color nozzles only for color and not mixed the two to avoid distinctive characteristic differences, as well as maintain print speed. FIG. 3A shows a simulated representation of a letter "A" formed using all black dots from the nozzles 22 of FIG. 3. All of the dots are black, represented by the reference character "B".

Figure 4:
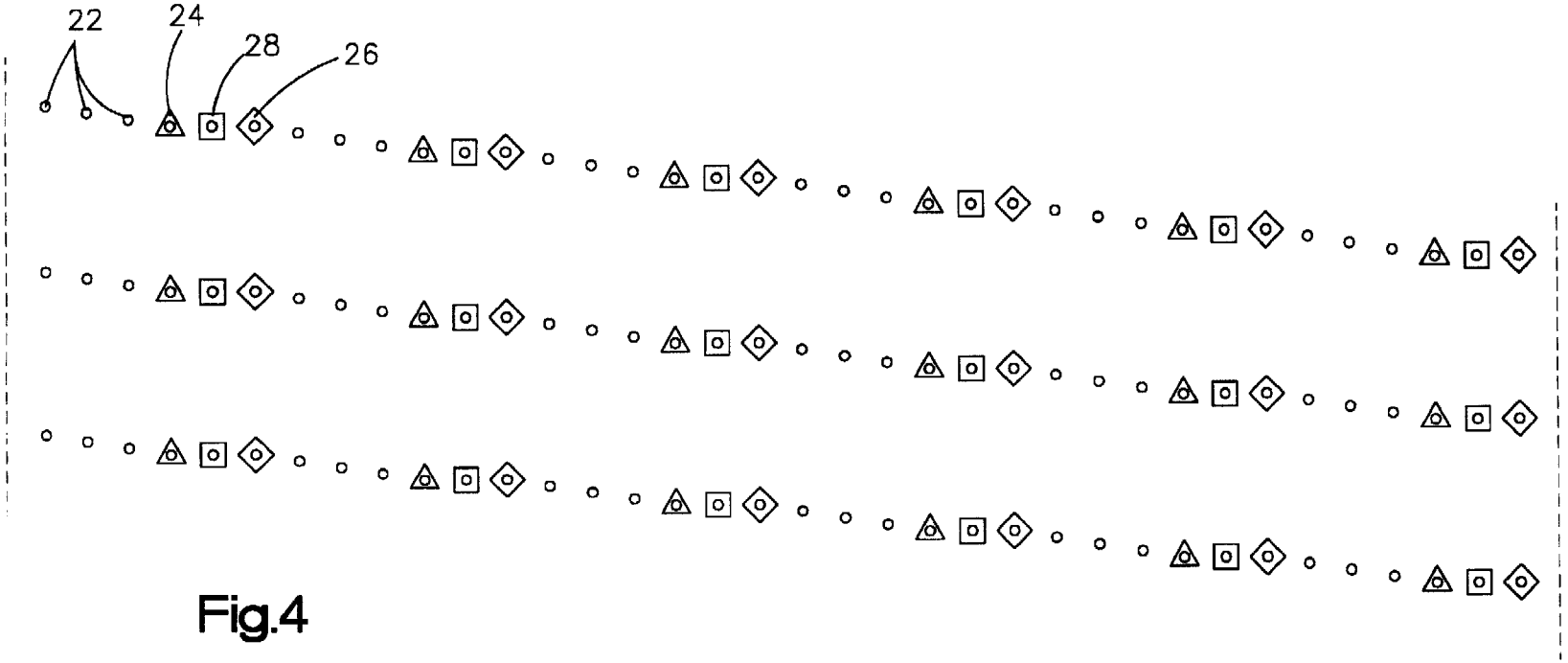
FIGS. 4–6 are representations of nozzle configurations for print heads that, according to this invention, that can print interspersed black ink and color ink pels.

Referring now to FIG. 4, one embodiment of a print head nozzle assembly printing according to this invention is shown. In this configuration, there are 108 nozzles, 54 black ink and 54 color ink nozzles (18 cyan, 18 yellow, and 18 magenta). In this arrangements, there are three diagonally slanted and aligned rows of nozzles with a horizontal distance "D" between adjacent nozzles 22, 24, 28, 26, in a row and the vertical distance between adjacent black ink nozzles 22 in a row of "P". Again, the distance "D" is the smallest distance that two nozzles can be manufactured and operated next to each other. The distance "P" is the distance associated with one pixel distance. Placed in a row after a set of three black ink nozzles 22 are three color ink nozzles—one cyan 24, one yellow 28 and one magenta 26. These three nozzles 24, 26, 28 are spaced a distance "D" apart on a line horizontally, i.e., there is no vertical space between them, but the horizontal space is the same as for the black ink nozzles. There are then three more black nozzles spaced a distance "P" from each other and horizontally spaced a distance of "D". This arrangement is repeated in each row of 36 nozzles. The vertical distance from the bottom-most color nozzle 26 of the top row to the top-most black nozzle 22 of the second row is equal to one pixel distance. It should be noted that the distance covered from the top-most left black ink nozzle 22 of the top row to the bottom-most row of cyan, yellow and magenta ink nozzles, 24, 28, 26, of the bottom row is 72 pixel distances or about 0.24 inches, i.e. 72×0.0033. Moreover, the distance between any two vertically aligned nozzles in two rows is equal to or greater than D. This means the distance is equal to or greater than the distance "D" for reasons explained above.

Figure 4A:
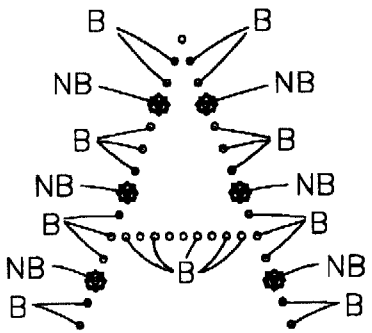

For printing a "black" character, the print head starts at the left and moves to the right as previously described with respect to FIG. 3. However, in addition to all of the black ink nozzles 22 being functional, the color ink nozzles will also be activated, with each of the cyan 24, yellow 28 and magenta nozzles 26 being actuated at a location at which a black dot is called for. The three color ink nozzles will combine to give a "near black" color as opposed to an actual black; however, the near black dots will be adjacent to and, in most cases, surrounded by true black dots with a 3-to-1 ratio of black to near black. The character printed gives the appearance of a true black even though every fourth dot in the printing is near black. FIG. 4A shows a simulated representation of the letter "A" similar to that of FIG. 3A, but as printed by the nozzle configuration in FIG. 4. In this case, the black dots are designated as "B", and the "near black" designated "NB". As can be seen, every fourth row of dots is "near" black. In one path or swath, a height of 0.24 inches is printed for "black" character, as opposed to the printing in the previously described prior art printing head wherein the height of 0.18 inches is printed. Thus, there is an increase of 33% of printing height over the prior art printing head with the same number of nozzles when printing a "black" character.

To print color in this configuration, the print head starts at the left and moves to the right. The color nozzles are each activated at any site where that particular color is to be printed as a part of the color. Thus, a swath of 72 pixel distances or 0.24 inches is printed with color printed on lines every four pixel distances, or 0.133 inches apart. When the print head reaches the right of the paper, it is reversed and the paper is incremented a distance of P. The print head then moves to the left, printing with the color nozzles, each being actuated and producing color on lines four pixel distances apart and a distance of P below the initial lines printed on the first pass. It is reversed again, the paper incremented another P, and the third pass is initiated with another series of color lines being produced 4 P apart and 1 P below the previous pass lines. When the head reaches the right end of the paper, the head is again reversed, and the paper is incremented another distance P. The fourth pass is then completed filling in the fourth line of color. At this point, a color swath 72 P, or 0.24 inches high, has been totally printed by the color ink jet nozzles 24, 26 and 28. Hence, 0.24 inches is covered in four passes, or 0.06 inches per pass. The head is then reversed and the paper incremented 72 P so that the next full swath of color can be printed. The speed with the color is done slightly faster than the configuration shown in FIG. 3 of the prior art. As seen from the prior art, five passes are required to produce 0.18" of color, or 0.036 inches per pass, until a steady state condition of printing is reached with the prior art configuration of FIG. 3. At this steady state condition, three passes are required to print 0.18 inches, or 0.06 inches per pass. Thus, the prior art only reaches speeds equal to the preferred embodiment at steady state.

It should be noted that in the embodiment of FIG. 4, there are the same number of black ink nozzles and color ink nozzles as in the prior art. However, they are spaced and utilized in such a way that by interspersing near black dots with black dots, a 33% increase in printing speed for black line characters can be realized, while providing a character that has, for all intents and purposes, the same black appearance as an all black character because of the dot interspersion and arrangement even though 25% of the dots are only near black. Additionally, some color throughput improvement will also be obtained.

Figure 5:
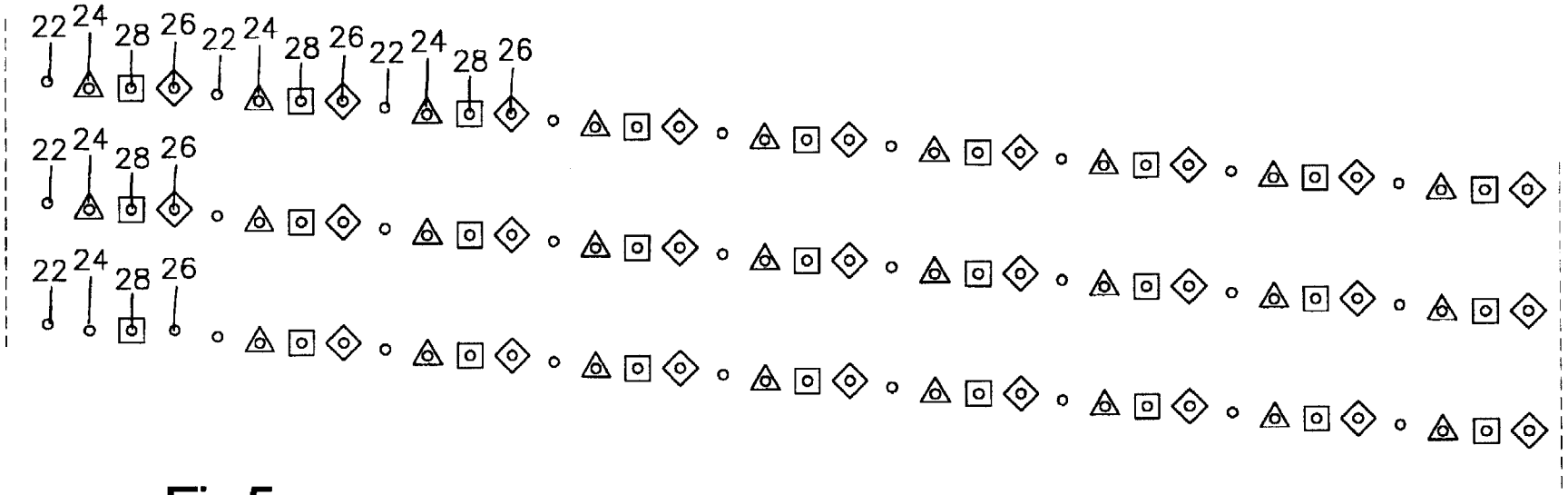
Figure 5A:
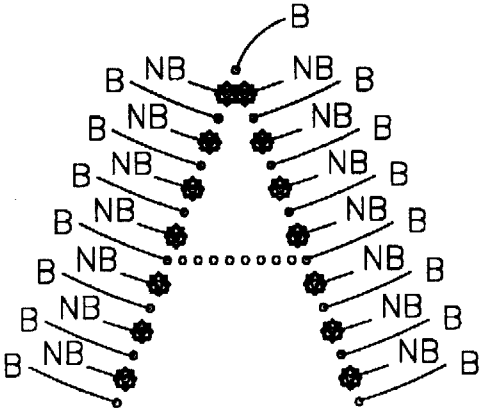

FIG. 5 shows another embodiment of the present invention wherein there are more color nozzles and fewer black nozzles, however the total number of nozzles remains the same, i.e., 108 nozzles. In this embodiment, the black is printed by the black nozzles 22 and near black is printed again by using a combination of cyan 24, yellow 28 and magenta 26. In this arrangement, there is alternately a black ink nozzle 22 and three color ink nozzles 24, 28, 26 on a horizontal line spaced below the black ink nozzle a distance P, followed by another black ink nozzle 22 spaced a distance P down from the three color ink nozzles 24, 28, 26, and again followed by three color ink nozzles 24, 28, 26 spaced a distance P below the black ink nozzle 22. Nozzles 24, 28 and 26 are in a horizontal line. Again, there are 36 nozzles in each row for a total of 108 nozzles. The black characters are obtained by alternate dots of black and a cyan, yellow and magenta combination providing a near black. In this pass, a character printing black from both the black and the three color nozzles will be printed in one swath 54 P high, i.e., about 0.18 inches high. The height of the swath is not as high as in the embodiment of FIG. 4 since there are more color ink nozzles 24, 26, 28 which are on a horizontal line, and less black ink nozzles 22. In this printing swath, there will be alternating black and near black dots which thus does not have quite the same appearance of the previous embodiment where there are three black dots for each near black dot, but nevertheless the black and near black dots are interspersed so that they give an essentially uniform appearance which is very close to black. FIG. 5A shows a simulated letter "A" representation similar to those of FIGS. 3A and 4A, but printed by the nozzle configuration of FIG. 5.

An advantage of this particular arrangement of FIG. 5 is that due to the higher number of color nozzles, a color swath of 54 P, i.e., 0.18 inches high, can be covered in two passes of 0.09 inches per pass, which means that the speed of putting on the color is increased by 50% over the previous embodiment, although the efficiency of the black is decreased by 33% over the previous embodiment.

Figure 6A:
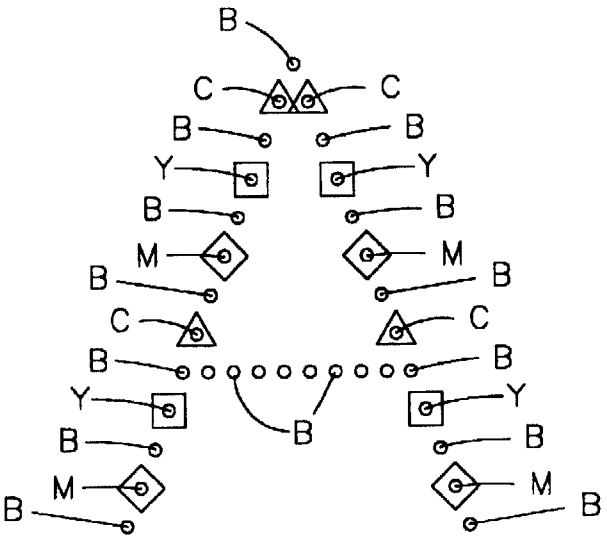
Figure 6:
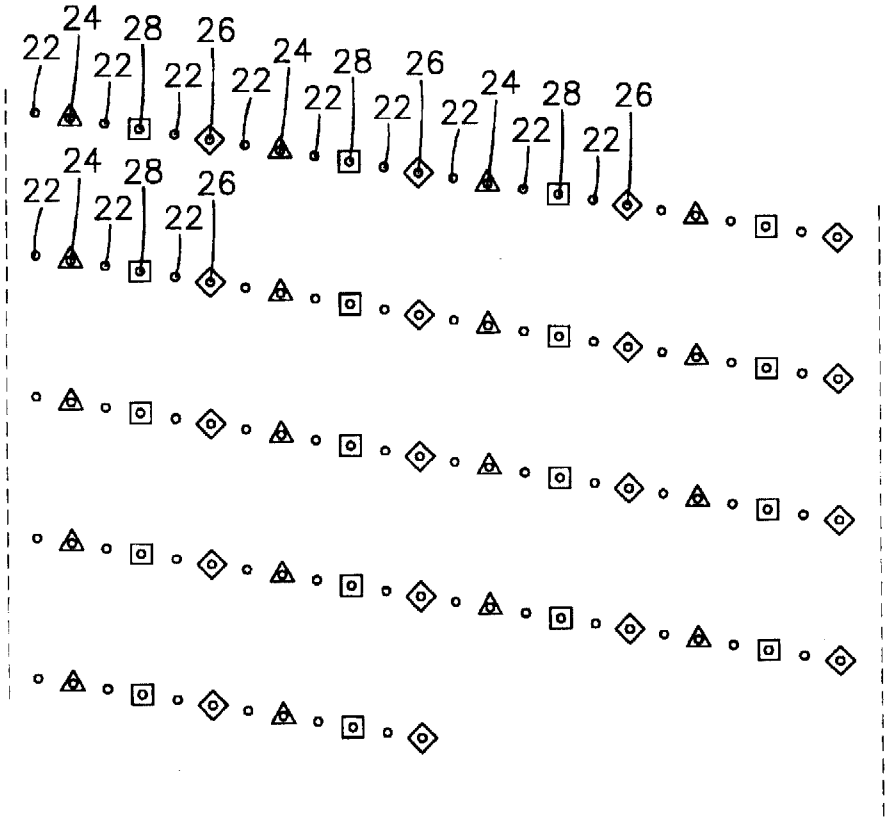

FIG. 6 shows another embodiment where a diagonal of the nozzles shows 54 black ink nozzles 22, and 18 each of cyan 24, yellow 28 and magenta 26 ink nozzles. In this embodiment, there is vertically alternating a black ink nozzle 22 and a color ink nozzle, either cyan 24, yellow, 28, or magenta 26, with each color nozzle being a different one of the three colors. In this case, the alternating dots between the black dots are not near black, but each a separate color, i.e., a cyan, a yellow or a magenta. It will be noted that in this embodiment, there are five diagonally slanted rows of nozzles rather than only three rows. This is not LQ or even NLQ; nevertheless it is acceptable for draft printing. Drafts can be printed in one pass, 108 P high, i.e., 0.36 inches. This is 50% faster than the embodiment of FIG. 4 and 100% faster than the embodiment of FIG. 5 and the prior art. Printing in the letter quality or near letter quality mode is accomplished in two passes, using the black nozzles only. There is an increment of P between passes, and 36 inches is printed in two passes or 0.18 inches/pass. For this configuration, with color printing, six passes are required, with the increment between passes being a distance of P, and this will print 0.36 inches of full color in six passes, or 0.06 inches per pass.

FIG. 6A shows a simulated letter "A" representation printed by the nozzle configuration of FIG. 6 showing the various colors, cyan C, magenta M and yellow Y, and black B dots, printing in this draft mode.

Instead of one color of cyan, magenta or yellow being interspersed between black dots, two color combinations can be interspersed to effect an improved appearance for draft mode printing. Two different color nozzles, in line horizontally, i.e., cyan and magenta or magenta and yellow, or yellow and cyan can produce blue, red and green respectively. The effect is an improved draft mode with the dispersed colors being red, green or blue. As in the embodiments above, the interspersed color dots should be bracketed above and below with true black dots.

Accordingly, the preferred embodiment of the present invention has been described. With the foregoing description in mind, however, it is understood that this description is made only by way of example, that the invention is not limited to the particular embodiments described herein, and that various rearrangements, modifications, and substitutions may be implemented without departing from the true spirit of the invention as hereinafter claimed.

What is claimed:

1. An ink jet printer, including a mechanism for receiving and incrementing paper vertically, a print head and mechanism for moving the print head horizontally across the paper, and a plurality of orifices and devices to eject ink drops from the orifice, and wherein the printer has a plurality of orifices to print black ink and colored ink, and wherein the color is generated by a plurality of different color inks, the black ink and each color from separate orifices, an improved nozzle configuration in a print head face plate comprising;

said orifices being arranged in a pattern in which the orifices are spaced vertically and horizontally with respect to each other, and wherein each color ink orifice is interposed between two black ink orifices in the vertically-spaced direction, and wherein each orifice is vertically spaced from all other orifices;

whereby a swath of printing can be formed with interspersed dots of black ink and colored ink.

2. The printer as defined in claim 1, wherein the orifices are arranged in at least one diagonally extending row, and wherein the spacing vertically between orifices does not exceed about one pixel.

3. A print head for an ink jet printer, including a mechanism for receiving and incrementing paper vertically, a print head and mechanism for moving the print head horizontally across the paper, and a plurality of orifices and associated operating devices to eject ink drops from the orifice, and wherein the printer has a plurality of orifices to print black ink and color ink dots, and wherein the color is generated by a plurality of different color inks, each color ink and black ink from separate orifices, an improved nozzle configuration in a print head face plate comprising;

said orifices being arranged in a pattern in which the orifices are spaced vertically and horizontally with respect to each other, and wherein each color ink orifice is interposed between two black ink orifices in the vertically-spaced direction, and wherein each orifice is vertically spaced from all other orifices;

whereby a swath of printing can be formed with interspersed dots of black ink and colored ink.

4. The print head as defined in claim 3, wherein the orifices are arranged in at least one diagonally extending row, and wherein the spacing vertically between orifices does not exceed about 1 pixel.

5. A method of printing material in an ink jet printer wherein said printer increments paper vertically and wherein said printer has a print head that traverses the paper horizontally and prints dots in each traverse in a swath from a plurality of black ink orifices which each emit drops of black ink on demand and a plurality of color ink orifices each of which emits one of a plurality of different colors of ink on demand, and wherein the orifices are spaced vertically and horizontally with respect to each other, and wherein each of the color ink orifices is interspersed vertically between two black ink orifices, and wherein each orifice to print black ink is vertically spaced from all other orifices and wherein individual color drops are interspersed between black ink drops comprising the steps of:

causing the print head to traverse the paper horizontally at least one time, and emitting both color ink drops and black ink drops from said color ink orifices and said black ink orifices respectively during said at least one traverse to thereby form characters having colored drops of ink interspersed between black drops of ink.

* * * * *